US005375316A

United States Patent [19]

Carlson et al.

[11] Patent Number: 5,375,316

[45] Date of Patent: Dec. 27, 1994

[54] BALE WIRE STRIPPING SYSTEM

[75] Inventors: Wayne Carlson, Oregon City; Carl N. Winans, Wilsonville; Frank Maniatis; Thomas Johnstone, both of Portland, all of Oreg.

[73] Assignee: Harris Waste Management Group, Inc., Peachtree City, Ga.

[21] Appl. No.: 937,756

[22] Filed: Sep. 1, 1992

[51] Int. Cl.[5] ..... B23P 19/00; B65B 69/00

[52] U.S. Cl. ..... 29/564.3; 83/156; 83/909; 83/923

[58] Field of Search ..... 29/564.3, 426.4; 83/909, 471.2, 676, 923, 156; 241/101.2, DIG. 38

[56] References Cited

U.S. PATENT DOCUMENTS

| | | | |
|---|---|---|---|
| 2,820,282 | 1/1958 | Schneider, Jr. | 83/909 X |
| 3,521,347 | 7/1970 | Bentley | 29/564.3 |
| 3,540,338 | 11/1970 | McEwan | 83/471.2 |
| 4,347,959 | 9/1982 | Ivinger | 83/923 X |
| 4,451,967 | 6/1984 | Stobb | 83/909 X |
| 4,835,836 | 6/1989 | van Uitert | 83/909 X |
| 4,841,619 | 6/1989 | Theriault | 83/909 X |
| 4,964,324 | 10/1990 | Pavlick | 83/923 X |
| 5,079,826 | 1/1992 | Ercums et al. | 29/564.3 |
| 5,105,527 | 4/1992 | Miyata | 29/564.3 |

*Primary Examiner*—Rinaldi I. Rada
*Attorney, Agent, or Firm*—Kirkpatrick & Lockhart

[57] ABSTRACT

A conveyored bale dewiring system for safe severing and removal of bale strap material from about a compressed bale composed of a planar table with an integral conveyor system, an overhead cutting assembly on an articulated balanced 4-bar linkage, a grasping blade and opposing meshed puller gears, a rotating drum anvil and rotating drum cutter head assembly, and containment safety shroud. The system consists of a continually moving conveyor on which the bales are loaded; a cutting head which floats over the top of irregular shaped bales and automatically grabs and cuts each strand in succession as the bale is moving forward on the conveyor, and a grabber and chopper unit which simultaneously grabs each strand and pulls it down through the conveyor deck into a rotary drum anvil which chops the wire or bands into a manageable length and deposits it into a holding bin. The system is designed to sequentially cut and retrieve as many strands as there may be on a bale while the bale remains in motion on the conveyor. As the wire or bands are removed, the product is delivered by the conveyor to other equipment for processing. The system not only provides an efficient, continuous stream of debaled product for processing, but eliminates the danger and injuries to workman of cutting and handling the unwieldy banding material. The system further processes the banding material into a saleable scrap product.

16 Claims, 9 Drawing Sheets

BALE WIRE STRIPPING SYSTEM

BACKGROUND OF THE INVENTION

1. Field of the Invention

The present invention is for a system for removing wire straps from a bale, and more particularly, pertains to a system which mechanically cuts and removes the strapping from the bale, and further processes the wire or banding as a saleable scrap material. The system can be used whenever and wherever baled materials are used and processed.

2. Description of the Prior Art

The baling of bulky materials is a common practice for their efficient handling, storage and transportation. These materials may include, but not be limited to recyclable materials such as waste paper, corrugated containers, plastic bottles or aluminum cans, as well as other products such as wood pulp, shavings, hay, solid waste, or any other non-cohesive bulk material. Baling is the densification of material in a compression chamber, and its containment by wrapping with strands of wire, steel bands or strapping ties. Usually several strands are required to contain each bale. At a factory, reclamation or processing facility where these products are used, it is necessary to remove the tie strands before processing. Most often the procedure is done manually with plier type wire cutters and the strapping removed and deposited into a receptacle by hand. Because the wire or banding is long, stiff and springy, it is difficult to control and dangerous to the workman handling it.

The most common method of dewiring baled materials is to approach each bale individually, manually cut the strands with a cutting pliers, grab by hand each wire strand and pull the wire from the bale. These strands often are rigid and/or springy wires or bands up to 24 feet in length, which are unwieldy and hazardous to handle. Sometimes the mass and/or dead weight of the baled material prevents a person from retrieving the wire or strapping which later may cause injury to other workmen or serious problems of product contamination or excessive wear and jamming of processing equipment.

The present invention provides a bale dewiring system which features automatic cutting and removal of a band, strap, or wire in a safe and efficient manner.

SUMMARY OF THE INVENTION

The general purpose of the present invention is to provide an affordable mechanical bale dewiring system. The system of the present invention sequentially, cuts, grabs, retrieves, chops and disposes of baling wire ties or wires preferably, but also bands or straps by way of example and for purposes of illustration only and not to be construed as limiting of the present invention, while a bale remains in motion on the conveyor, traveling along the path.

The dewiring system includes a conveyor table into which an overhead cutting head assembly and a lower table-top dewiring system is installed with respect to each other. A moving conveyor chain in the conveyor table advances tied bales across the dewiring system, and moves the loose bale on to further processing.

The overhead cutting head assembly is installed over the conveyor table on a counter-balanced hydraulically-assisted bar linkage articulating support arm and ramped slide shoe with a sensor which detects the top of each bale as the bale advances. Within the cutting head assembly is a powered vertical rotating toothed clipping blade, which progressively slices through the top of each bale, engaging and cutting each wire or strap as the bale is advancing on the conveyor.

The dewiring system is installed in the conveyor table. A powered vertically oriented rotating toothed grabber blade protrudes above the table, slicing through the bottom of the bale, engaging each wire or strap, pulling it downward below the table deck into rotating wire puller gears. Longitudinally installed rollers each side of the grabber blade provide a transition for the wire from the bale into the wire puller gears.

The wire puller gears are an offset counter meshing gear system mounted on shafts below and to each side of the grabber blade. The puller gears engage the wire from the grabber blade and feeds it through a drum type anvil and drum cutter which chops the wire into small, convenient lengths for later recycling. The chopped wire or strapping drops freely from the bale dewiring system and into a desired scrap recycling container via a suitable conveyor system.

The dewiring gears are hydraulically powered with all moving parts directly connected through a specially designed gear box offering oppositional meshed rotation. In the alternative, any suitable powering means, such as electrical or pneumatic power may be used to power the dewiring gears.

The bale dewiring system includes a table framework, a cutting head assembly secured to an articulated 4-bar linkage, a conveyor system for bale conveyance along the table framework, and a dewiring assembly including a grabber blade, opposing and meshing wire or strap puller gears, and a rotary drum anvil and rotary drum cutter assembly.

For independent removal, serviceability and maintenance, the grabber blade and wire puller gear mechanism is a modular assembly as is the rotary anvil and cutter mechanism.

One significant aspect and feature of the present invention is a bale dewiring system having a cutter head mounted on an articulating counter balanced 4-bar linkage and having a slide shoe.

Another significant aspect and feature of the present invention is a bale dewiring system having a height sensing device to assist in initial positioning of the 4-bar linkage and slide shoe.

Still another significant aspect and feature of the present invention is a dewiring assembly having transitional side rollers.

Yet another significant aspect and feature of the present invention is a dewiring assembly having a grabber blade.

A further significant aspect and feature of the present invention is a dewiring assembly having a grabber blade which feeds strapping to wire puller gears.

Still a further significant aspect and feature of the present invention is a dewiring assembly having a rotary drum anvil and rotary drum cutter head.

An additional significant aspect and feature of the present invention is the ever increasing speed of throughput of strap material through the rotating mechanisms.

A further significant aspect and feature of the present invention is the use of flight bars to provide extra traction and to elevate the bale above the level of the conveyor chain, which allows passage of the cut strands to be pulled out from under the bale.

Yet a further significant aspect and feature of the present invention is the use of a shroud or positioned vertical safety side walls which protect workmen from sometimes violently flinging wire as the strands under tension are cut. The shroud also restrains the loose debaled material on the conveyor table and directs it from the table as it advances.

Having thus described the embodiments of the present invention, it is the principal object hereof to provide a bale dewiring system for removal and processing of band, wire, tie or strap material from and about baled material.

One object of the present invention is a system which includes a conveyor and classifier to separate the cut wire segments from debris and chaff drawn through the puller and cutter with the wire. The chaff would be returned to the processing line and the wire deposited into a tote bin or barrel.

Another object of the present invention includes a system with the adaptability to include a bale positioning (orientation) infeed conveyor.

A further object of the present invention is a system which includes the adaptability to include a rotary bale breaker/fluffer device which helps meter the baled material onto a conveyor for processing.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
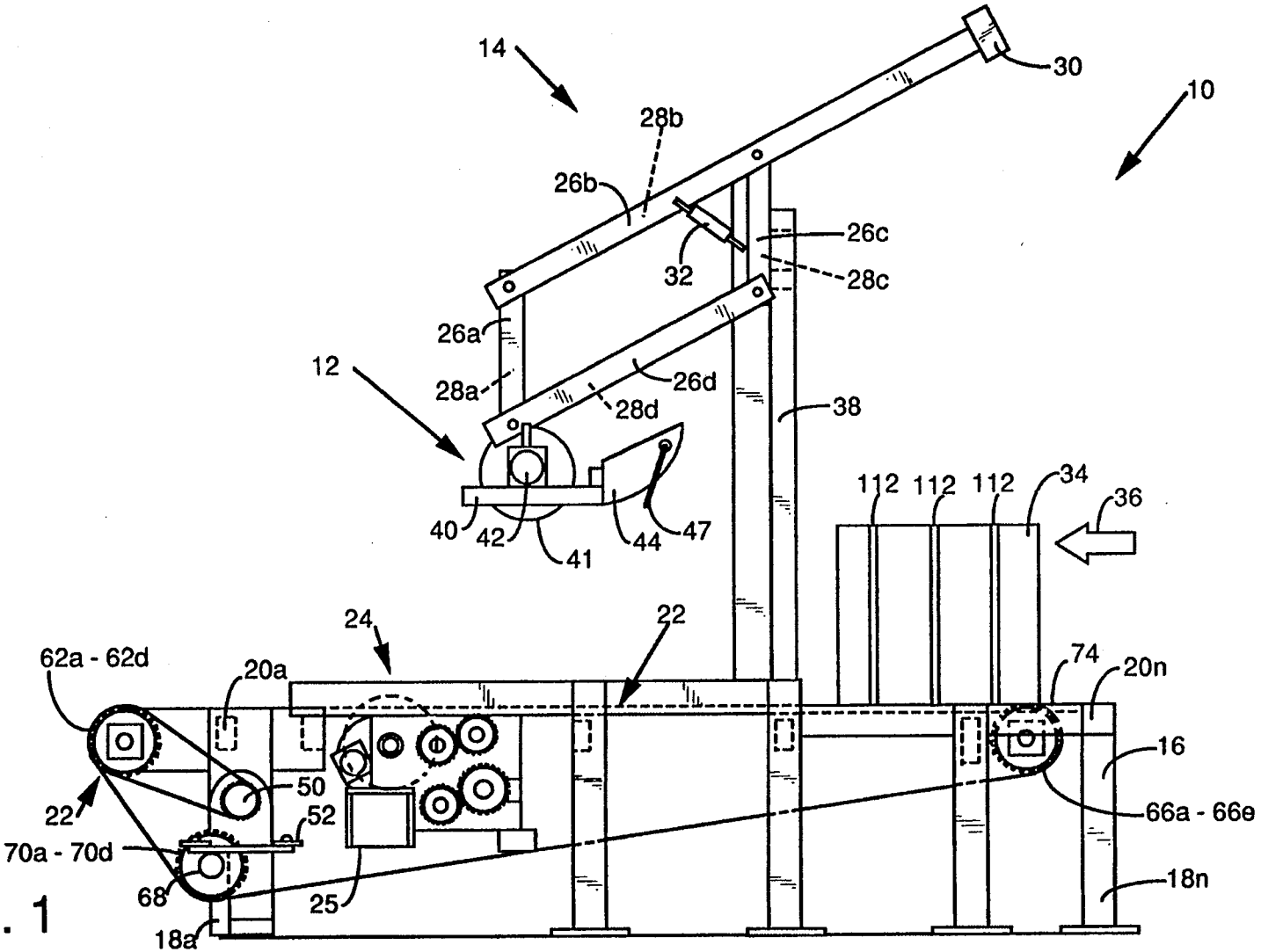
FIG. 1 illustrates a side view of the bale dewiring system, the present invention.

FIG. 1 illustrates a side view of a bale dewiring system 10, the present invention, including a cutting head assembly 12 secured to a 4-bar linkage 14, a framework 16 having a plurality of vertical members 18*a*–18*n* and a plurality of horizontal members 20*a*–20*n*, a table conveyor system 22 and a dewiring assembly 24.

The cutting head assembly 12 secures to a 4-bar linkage 14 having bars 26*a*, 26*b*, 26*c* and 26*d*, and bars 28*a*, 28*b*, 28*c* and 28*d* lying behind the bars 26*a*–26*d* with appropriate cross bars secured therebetween. Linkage bars 26*b* and 28*b* are extended to support a counter weight 30. A hydraulic cylinder 32 is positioned between the linkage bars 26*b* and 26*c* to articulate the 4-bar linkage assembly 14 which subsequently positions the cutting head assembly 12 with respect to baled material such as bale 34 which is conveyed in a first direction 36 by the conveyor system 22. A vertical support assembly 38 extends vertically from the framework 16 to support the 4-bar linkage 14 and the cutting head assembly 12. The cutting head assembly 12 includes a framework 40 secured to the 4-bar linkage 14, a motor 42, preferably hydraulic, secured to the framework 40, a rotating toothed clipping blade 41, and a ramped shoe member 44. The ramped shoe member 44 contacts the lead edge of the bale 34 to adjust the height of the lower edge of the framework 40 to match the top surface of the bale 34. Circuitry is triggered to hydraulically or otherwise articulate the 4-bar linkage assembly 14 by the hydraulic cylinder 32 to position the cutting head assembly 12 to the approximate bale height as sensed by a sensor device 47 secured to the ramped shoe member 44. The height of each bale is detected by the sensor device 47 to automatically position the cutting head assembly 12 to clear the bale and then descend to ride along the bale upper surface.

Figure 3:
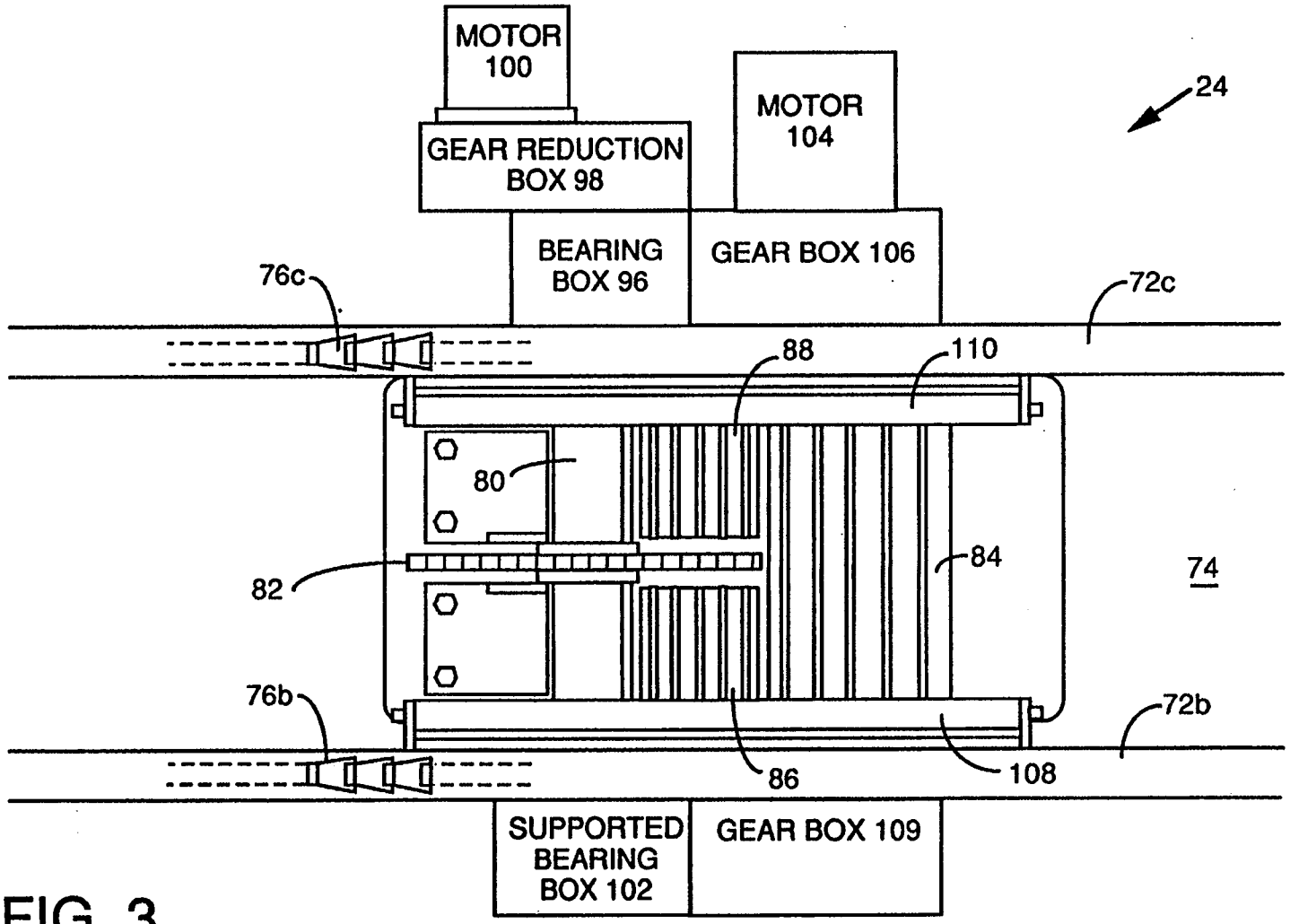
FIG. 3 illustrates a top view of the dewiring assembly.

The dewiring assembly 24 secures to a heavy steel member 25 and includes a wire grabber blade, wire puller gears, a wire cutter, an anvil, as well as other members as illustrated and described in FIG. 3.

Although not specifically illustrated, the dewiring assembly is of modular design consisting of a grabber blade and puller gear mechanism and a wire cutter and anvil mechanism.

Figure 2:
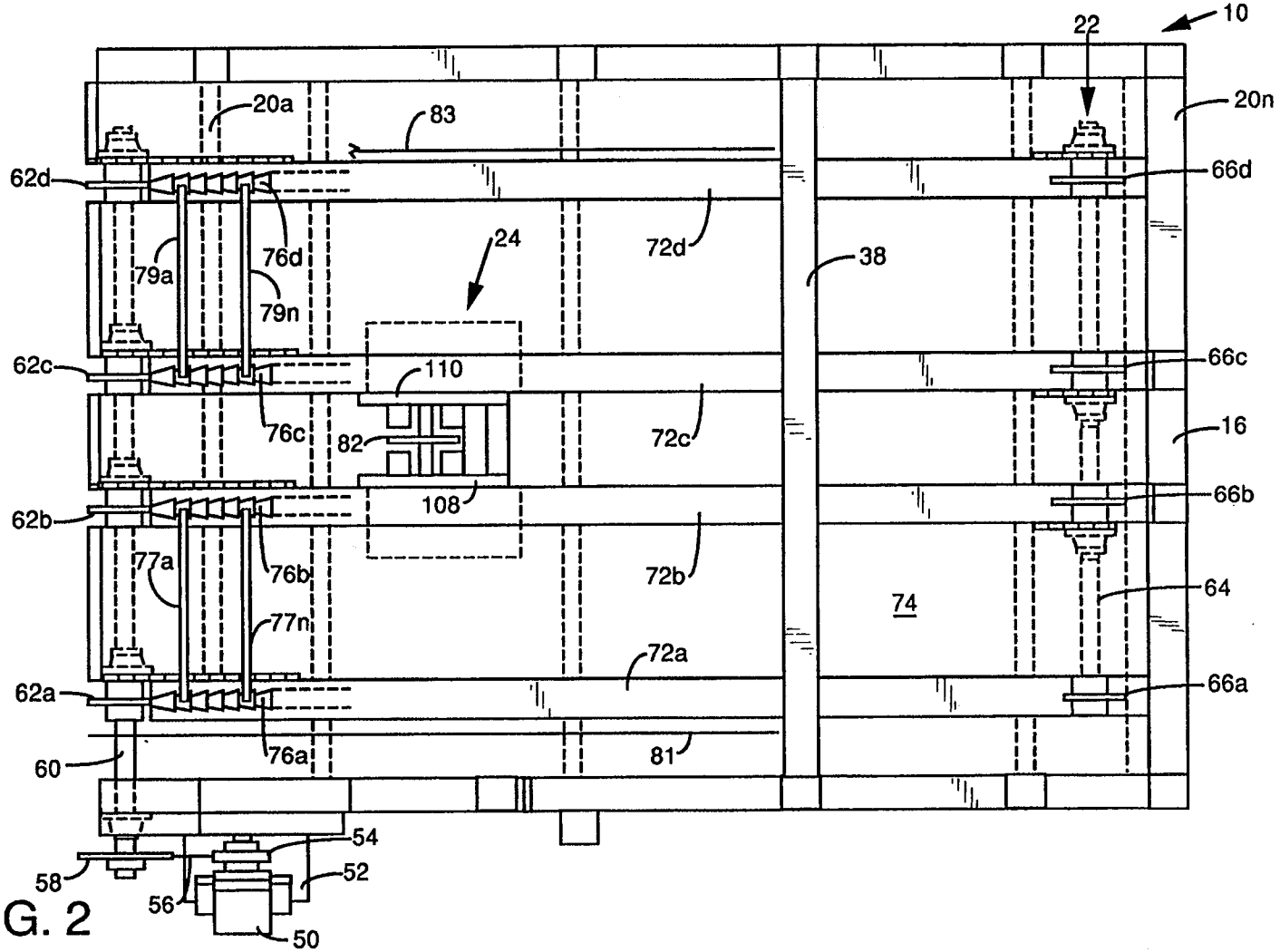
FIG. 2 illustrates a top view of the bale dewiring system.

FIG. 2 illustrates a top view of the bale dewiring system 10 where all numerals correspond to those elements previously described. The cutting head assembly 12 and the 4-bar linkage 14 are not shown in detail for purposes of brevity and clarity. Mounted to the framework 16 is a conveyor system 22 including a planar table 74, a motor 50, preferably hydraulic, mounted via a bracket 52 to the framework 16, a driven sprocket 54 and drive chain 56, a driven sprocket 58 over a frame mounted drive shaft 60, and sprockets 62*a*–62*d* secured over and about the frame mounted drive shaft 60. Another frame mounted shaft 64 aligns at the opposite framework end 16 and includes sprockets 66*a*–66*d* aligned along its length. A lower frame mounted shaft 68 includes sprockets 70*a*–70*d* as illustrated in FIG. 1. Chain trays 72*a*–72*d* align on top of the planar table top member 74 to accommodate chains 76*a*–76*d* which also engage sprockets 62*a*–62*d*, 66*a*–66*d* and 70*a*–70*d*.

A plurality of flight bars 77*a*–77*n* secure across the chains 76*a*–76*b* and a plurality of flight bars 79*a*–79*n* secure across the chains 76*c*–76*d*. The bars 77*a*–77*n*, 79*a*–79*n* extend generally perpendicular to the first direction 36, as seen in FIG. 2. Bales 34 are held above the level of the chains 76*a*–76*n* on the flight bars 77*a*–77*n* and 79*a*–79*n*. This is an important function in that the bale straps 112 are not forcibly held or pinched between the chain members 76*a*–76*d* and the bale 34 itself, but are free to be drawn from about the bale 34 subsequent to cutting of the bale straps 112. The problem of premature breakage of the straps caused by the weight of the bale pressing the straps against the chains is alleviated. The flight bars 77*a*–77*n* and 79*a*–79*n* move the destrapped bale along the planar table 74 subsequent to strap cutting and removal. Vertically aligned safety shroud walls 81 and 83 of sufficient height align parallel along the outer portion of the table 74, and chains 76*a* and 76*d* contain cut strapping and bale material which delaminates subsequent to strap cutting and removal.

Figure 4:
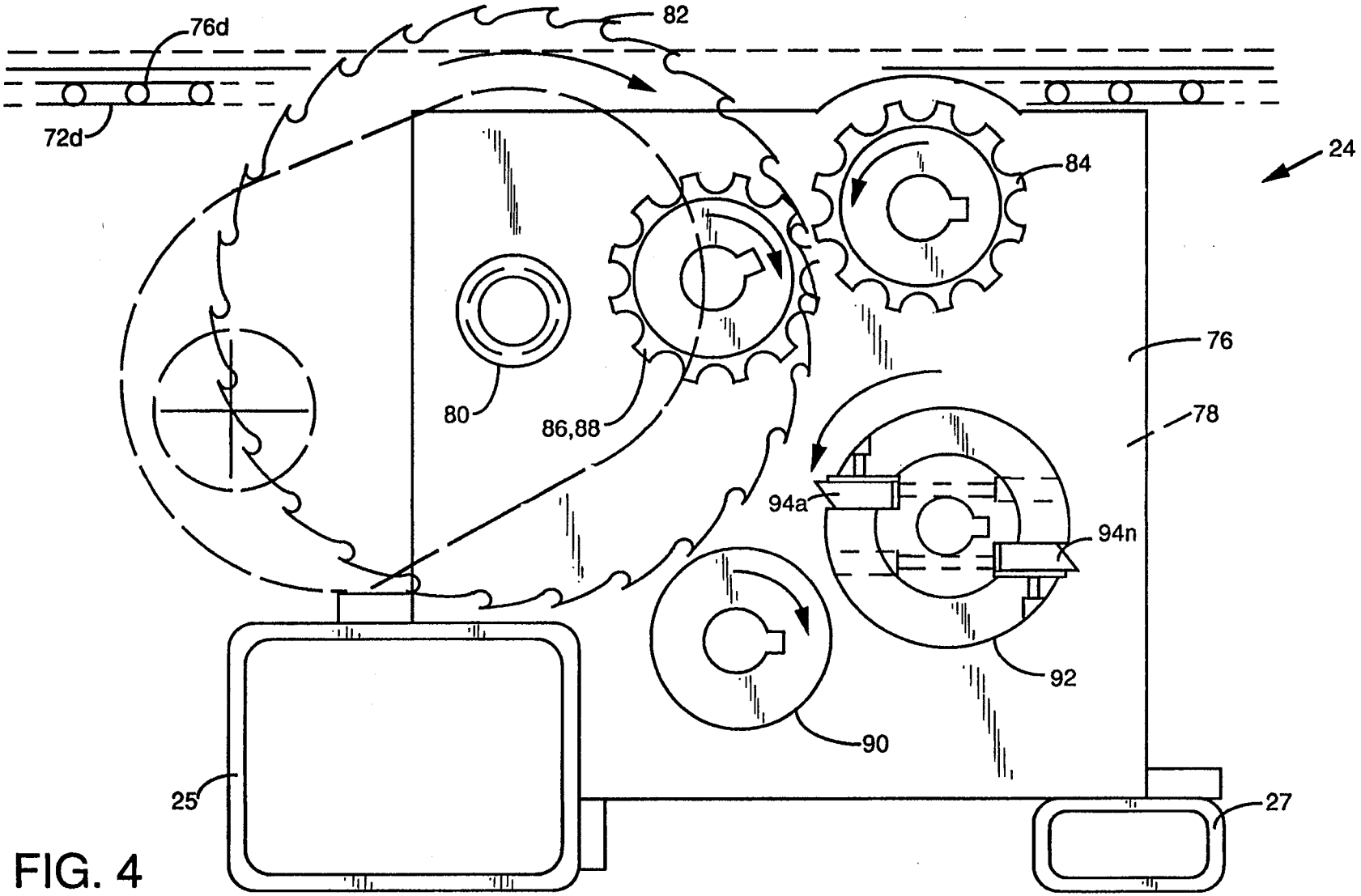
FIG. 4 illustrates a side view of the dewiring assembly.
Figure 12:
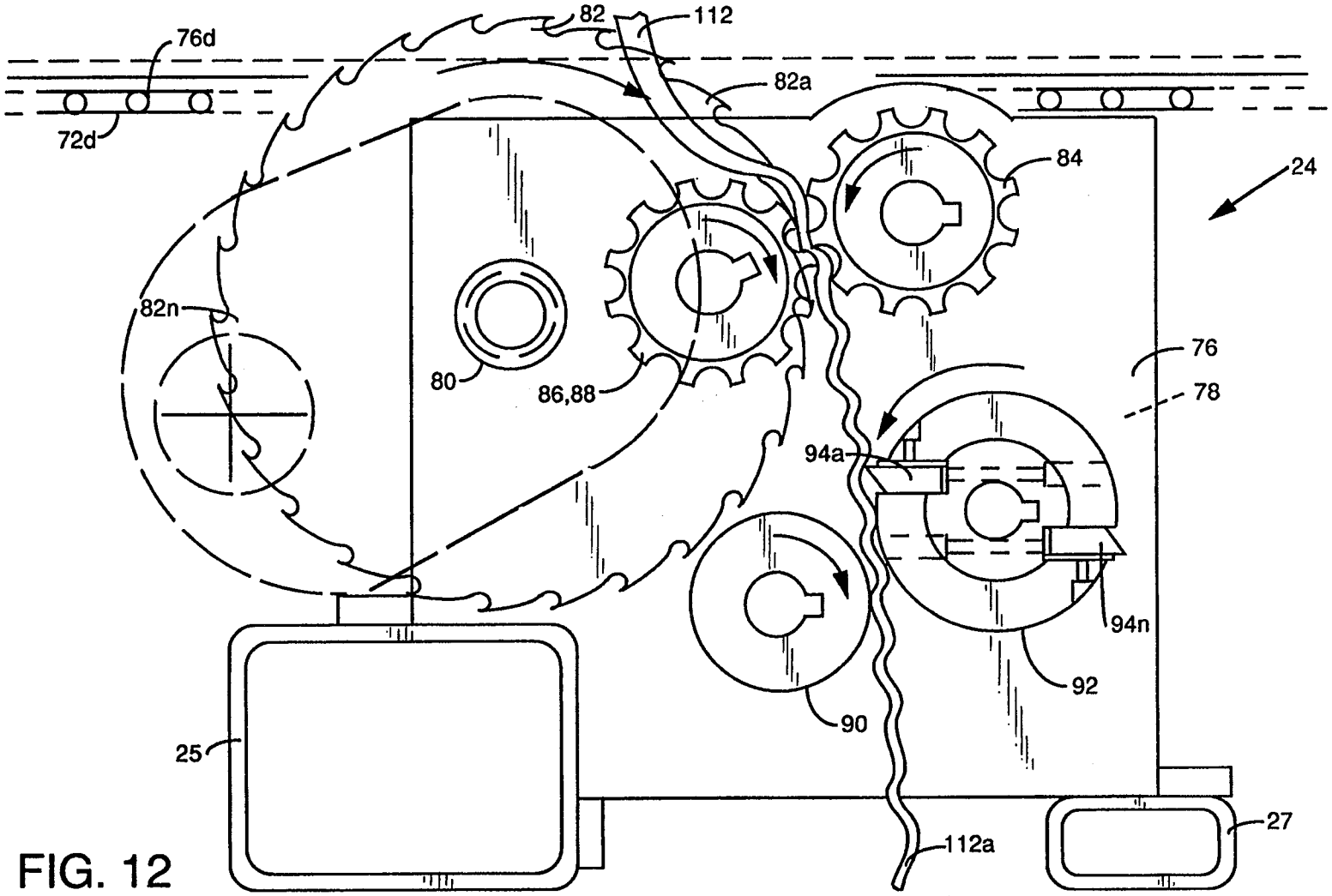
FIG. 12 illustrates an operational view of the dewiring assembly.

FIGS. 3 and 4 illustrate a top view and a side view of the dewiring assembly 24 where all numerals correspond to those elements previously described. The dewiring assembly 24 is located below the planar table top member 74 and between the chain trays 72*b* and 72*c*. Opposing plate components 76 and 78 of dewiring assembly 24 extend downwardly from the framework 16 of FIG. 1 and secure to steel cross members 25 and 27. Suspended between or extending from an area near plates 76 and 78 is a grabber shaft 80 having a grabber blade 82, a full length driven wire puller gear 84, half-length driven wire puller gears 86 and 88 flanking the grabber blade 82, a rotating drum anvil 90 and a rotating drum cutter head assembly 92 having a plurality of cutter blades 94*a*–94*n* about its periphery. Connected to one end of the grabber shaft 80 is a bearing box 96, a gear reduction box 98 and a motor 100, preferably hydraulic. A supported bearing box 102 aligns with the opposing end of the grabber shaft 80. Another motor 104, preferably hydraulic, secures to a gear box 106. The wire puller gear 84 is driven directly by the motor 104 through the gear box 106. The gear box 106 also contains gearing which drives the wire puller gear 88 in a direction opposite to and meshing appropriately with the wire puller gear 84. This meshing is illustrated in FIG. 4. A gear box 109 opposing the gear box 106 has a gear assembly not unlike that found in the gear box 106. A gearing on the end of the wire puller gear 84 in the gear box 109 drives the wire puller gear 86 in a direction opposite to that of the wire puller gear 84 and also meshes in an appropriate fashion. The wire puller gears 84 turn faster than the grabber blade 82 which engage the cut wires 112 pulling them from the grabber blade 82 and into the rotating cutter head assembly 92 and anvil 90 as illustrated in FIG. 12. Longitudinally aligned rollers 108 and 110 adjacent to the chain trays 72*b* and 72*c* extend generally in the first direction, as seen in FIG. 3, provide for transition of the cut wire from the bale and into the wire puller gears 84, 86 and 88. The rotating drum anvil 90 and the rotating drum cutter head assembly 92 are driven at different rates by a gear box assembly and motor (not illustrated). Although some components are described as being hydraulically powered, any suitable power means may be used, such as electrical or pneumatic.

Although not specifically illustrated, the dewiring assembly 24 described herein is of modular design composed of the grabber blade 82, puller gear mechanism 80, 84 and 86, wire cutter assembly 92, and anvil mechanism 90.

Figure 5:
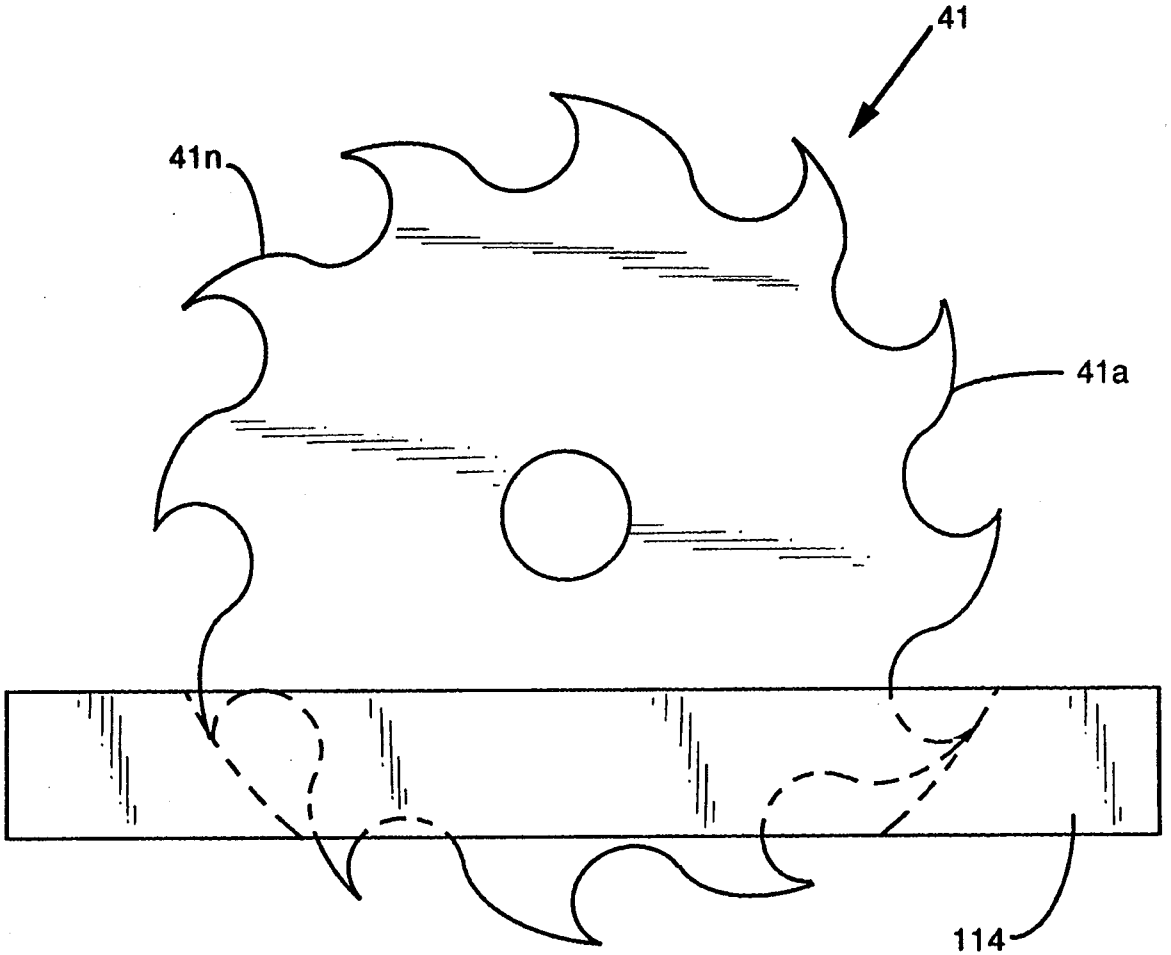
FIG. 5 illustrates a side view of the rotating tooth clipping blade and an anvil support.

FIG. 5 illustrates a side view of the rotating toothed clipping blade 41 and an anvil support 114. Deep gullets are provided for absorbing any paper or other materials during the clipping operation, which may be picked up by the tooth along with the bale wire. There is a sharp edge provided all the way around each tooth 41*a*–41*n*. The tooth 41*a*–41*n* comes against the anvil support 114, where either one or two anvil supports 114 can be provided about the clipping blade 41 for clipping the wire when the tooth 41a-41n and the wire come together at the anvil support 114, the wire is cut. The rotary clipping blade 41 and the anvil support 114 work against each other and acts as a shear, thus cutting the wire.

Figure 6:
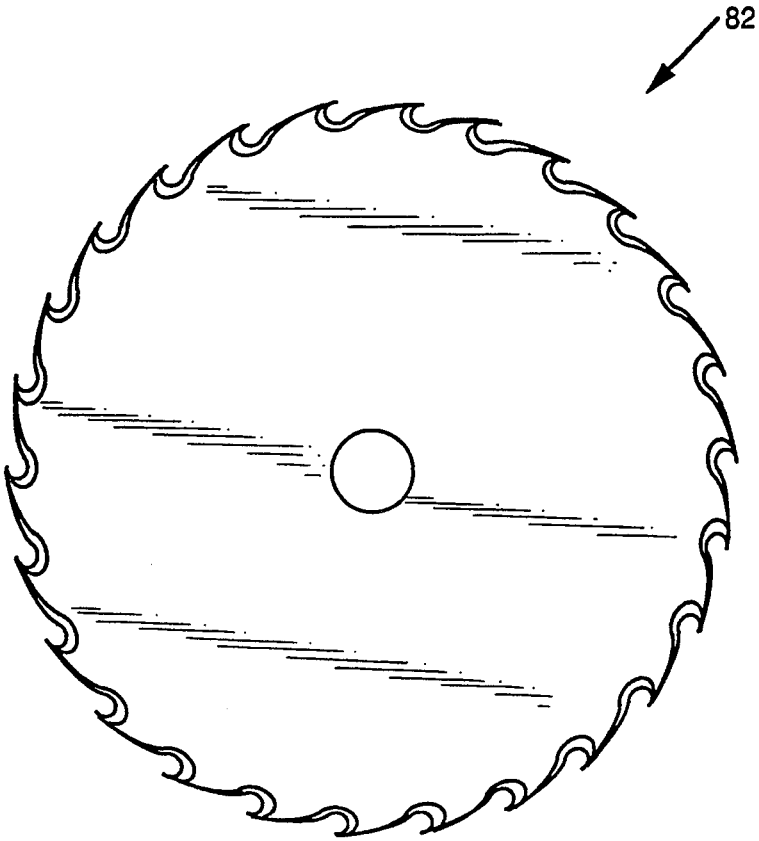
FIG. 6 illustrates a side view of the grabber blade.

FIG. 6 illustrates a side view of the grabber blade 82 where all numerals correspond to those elements previously described.

Figure 7:
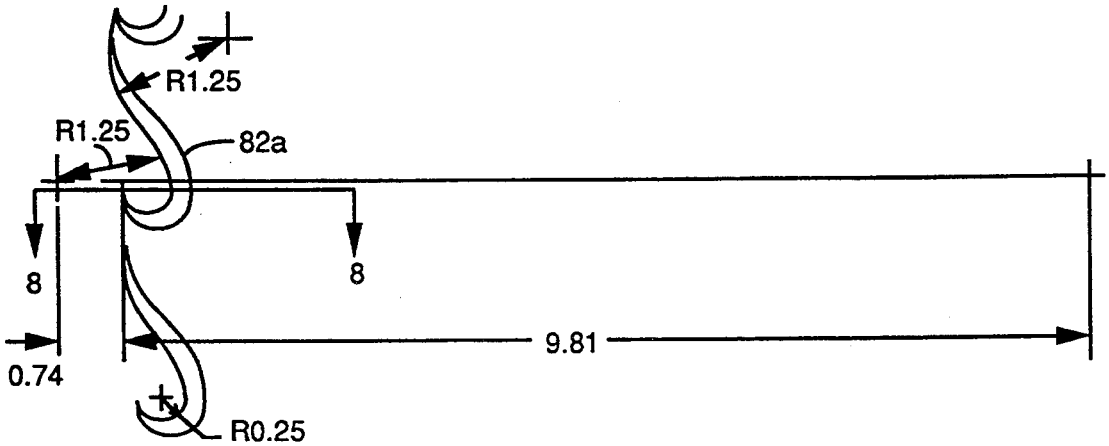
FIG. 7 illustrates an enlarged view of teeth of the grabber.

FIG. 7 illustrates an enlarged view of a tooth 82*a* of the grabber blade 82 of FIG. 6 where all numerals correspond to those elements previously described.

Figure 8:
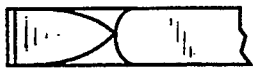
FIG. 8 illustrates a view taken along line 8—8 of FIG. 7.

FIG. 8 illustrates a view taken along line 8—8 of FIG. 7 illustrating the rounding of the tooth 82*a* so as to grab the wire, but not to break the wire. The rounding is at the throat of the gullet so as to provide for the grabbing of the wire. All other numerals correspond to those elements previously described.

Figure 9:
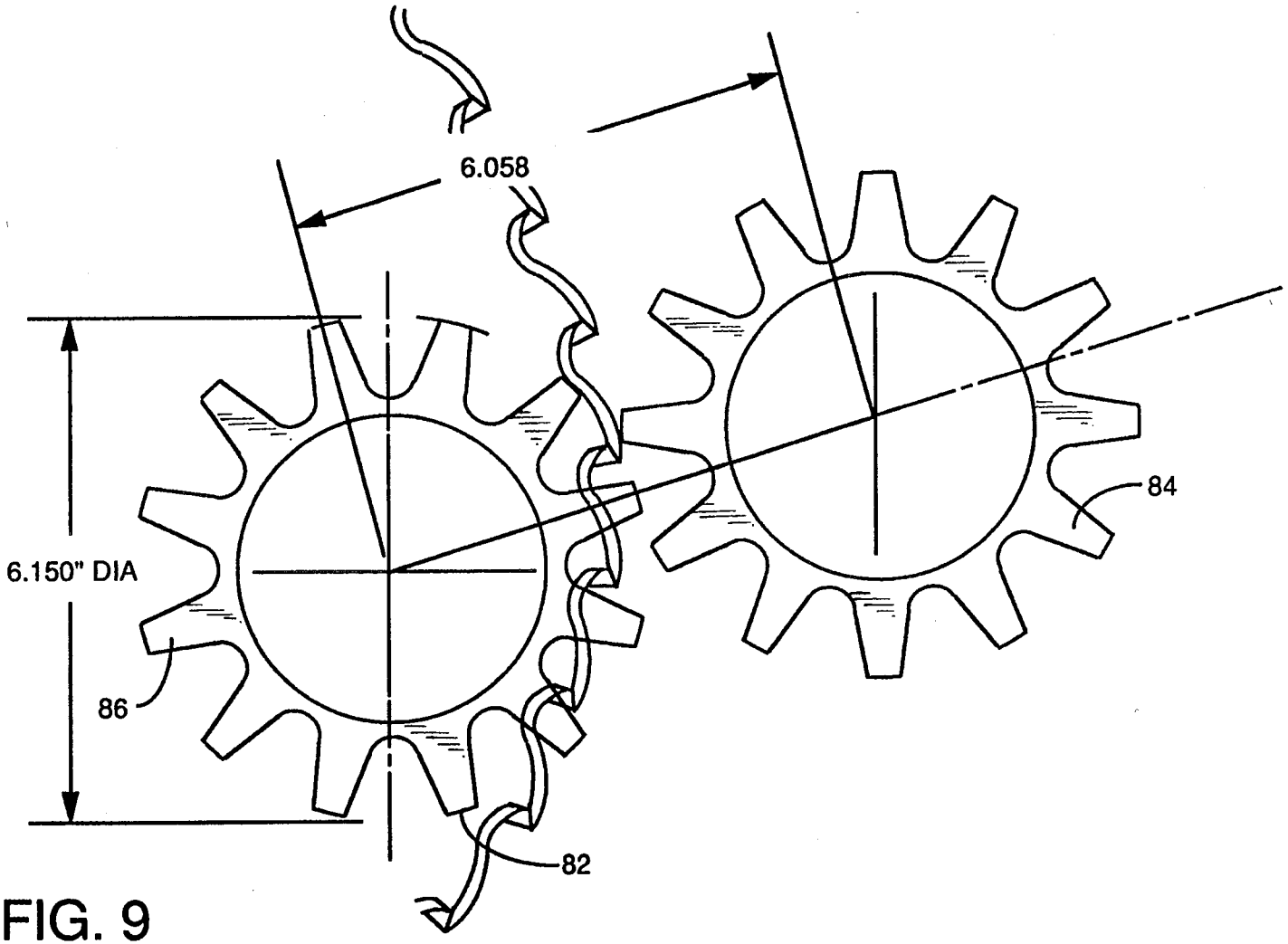
FIG. 9 illustrates a side view of a grabber and puller interface.

FIG. 9 illustrates a side view of two of the wire puller gears 84 and 86 with respect to the grabber blade 82, where the puller gears 84 and 86 turn faster than the grabber blade 82. All other numerals correspond to those elements previously described. The gears by way of example and for purposes of illustration only are of a diameter of 6.15" and are not to be construed as limiting of the scope of the present invention. The distance between the two pullers is 6.058" or about 6 1/16" to 6 3/16" so that there is an overlap of the gear teeth of approximately ⅛". This provides for corrugation shape to assist in offsetting the wire to provide the purchase to pull the wire down at the same time and somewhat corrugates the wire as it is being pulled. The gullets for these puller gears are also deep, providing that any paper or material has a place to pass whenever that material is pulled with the wire.

Figure 10:
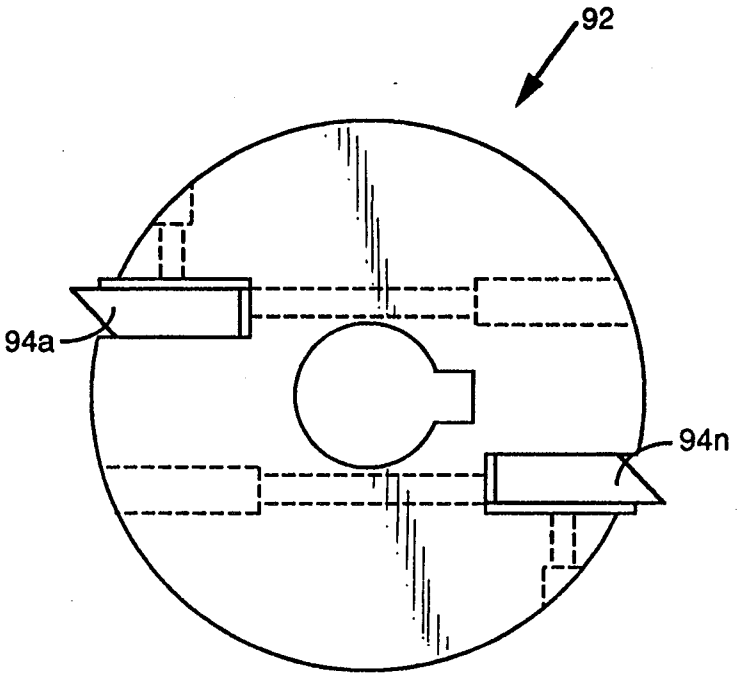
FIG. 10 illustrates a side view of the chopper.

FIG. 10 illustrates a side view of the rotating drum cutter 92. The rotating drum cutter 92 is a rotary chopper and rotates very close to within one ten thousandths of an inch of a rotating drum anvil 90 that is also rotating. All other numerals correspond to those elements previously described.

Figure 11:
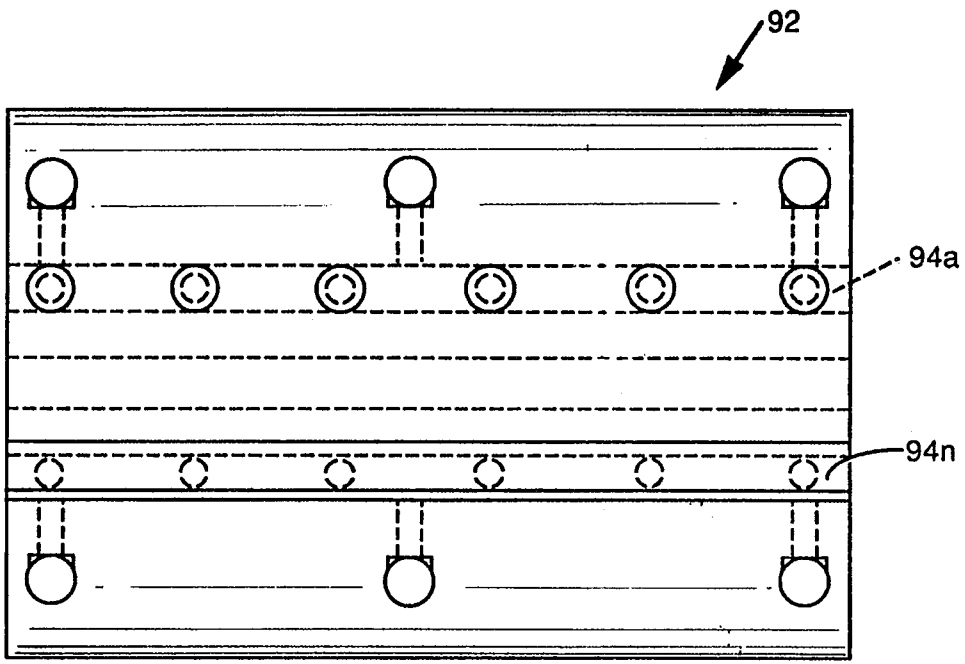
FIG. 11 illustrates a front view of the chopper.

FIG. 11 illustrates a front view of the rotating drum cutter 92 where all numerals correspond to those elements previously described.

MODE OF OPERATION

FIG. 12 in conjunction with FIG. 1 and the other figures best illustrate the operational mode of the dewiring assembly 24 of bale dewiring system 10 where all numerals correspond to those elements previously described. An incoming strapped and compressed bale 34 travels along and above the table top planar member 74 by the upper portion of the conveyor system 22. The ramped shoe member 44 and sensor device 47 detect the vertical height of the bale 34 to control circuitry which operates the hydraulic cylinder 32 to articulate the 4-bar linkage 14 to initially adjust the height of the cutting head assembly in accordance with the bale height. The rotating toothed clipping blade 41 then cuts the first of bale straps 112, thus relieving tension of the bale strap 112 about the bale 34.

The freed bale strap 112 is grasped by the teeth 82*a*–82*n* of the grabber blade 82 and then pulled downwardly and fed into the rotating wire puller gears 84–88 as illustrated in FIG. 5. The engagement of the bale wire strap 112 by the meshed wire puller gears 84 with those of gears 86 and 88 pulls the bale straps 112 from about the bale 34, over longitudinal rollers 108 and 110 and feeds the bale straps 112 between the rotating drum anvil 90 and the rotating drum cutter head 92 to be cut or severed into manageable short straps, such as strap 112*a*, allowing the straps 112 to be efficiently packaged for subsequent recycling. A length of a manageable length can be in a range of 6" to 24".

It is also noted that the rotary gear members turn at increasingly different speeds throughout the dewiring process to offer a throughput where each subsequent event tends to pull the strap material from the prior event members. The wire puller gears 84, 86 and 88 turn at a rate such that the teeth end points move slightly faster than the teeth end points of the grabber blade 82. In a like fashion, the rotary drum anvil 90 and rotary drum cutting head 92 each move at a greater end point rate than that of the wire puller gears 84–88. Further, the rotary drum anvil 90 and rotary drum cutting head 92 are rotated at different rates with respect to each other to preclude excessive rotary drum anvil wear. In this manner and fashion the cutter blades 94*a*–94*n* strike the rotary drum anvil 90 at different points instead of striking the same point at each rotation, thus alleviating wear on any one anvil surface.

Various modifications can be made to the present invention without departing from the apparent scope hereof.

We claim:

1. A system for removing bale straps from bales, comprising:

a conveyor system to convey the bales in a first direction, means for cutting the bale straps as the bales are conveyed by said conveyor; and means for grabbing the cut bale straps and pulling them around and away from the bales, said grabbing and pulling means including a rotating blade having teeth thereon to grab the bales straps and a pair of puller gears located adjacent said blade and having teeth thereon to pull the bale straps from the blade, wherein tooth end points of said puller gears move slightly faster than tooth end points of said blade to pull the bale straps from said blade.

2. A system as claimed in claim 1, wherein said teeth of said blade have rounded gullets to avoid breaking the bale straps.

3. A system as claimed in claim 1, wherein said teeth of said puller gears have deep gullets therebetween to accommodate excess material pulled with the bale straps.

4. A system as claimed in claim 1, further including means downstream of said puller gears, for chopping said bale straps into smaller lengths.

5. A system as claimed in claim 4, wherein said chopping means includes a rotary drum cutter having cutter blades mounted therein, and a rotary drum anvil, said cutter blades rotating very close to said rotary anvil to chop the blade straps into smaller lengths.

6. A system as claimed in claim 5, wherein end points of said cutter blades move slightly faster than said tooth end points of said puller gears, to pull the bale straps from the puller gears.

7. A system as claimed in claim 1, wherein said cutting means is mounted to a support assembly above said table, and said grabbing and pulling means is mounted in said table.

8. A system as claimed in claim 7, wherein said cutting means is mounted to said support assembly by a four-bar linkage.

9. A system as claimed in claim 8, further including a hydraulic cylinder connected to said linkage to move said linkage and adjust the height of said cutting means, a sensor device to detect the height of the bales, and control circuitry to control said hydraulic cylinder in response to an output of said sensor device.

10. A system as claimed in claim 1, wherein said cutting means is a rotatable toothed blade.

11. A system for removing bale straps from bales, comprising:

a conveyor table, said conveyor table including a motor, a drive mechanism driven by said motor for conveying the bale along said table in a first direction, and a plurality of horizontal bars attached to said drive mechanism generally perpendicular to said first direction to support the bales above said table;

means, mounted above said table, for cutting the bale straps as the bales move along said table;

means, mounted in said table, for grabbing the cut bale straps and pulling them around the bales and underneath said table; and a pair of rollers extending generally in said first direction and located on either side of said grabbing and pulling means, to allow the bale straps to be pulled underneath the bales.

12. A system as claimed in claim 11, wherein said grabbing and pulling means includes a rotating blade having teeth thereon, said teeth having rounded throats to avoid breaking the bale straps.

13. A system as claimed in claim 12, wherein said grabbing and pulling means further includes a pair of puller gears located adjacent said blade to pull the bale straps from said blade, and a rotating drum anvil and cutter head assembly to pull the bale straps from said puller gears and cut the bale straps into smaller lengths.

14. A system as claimed in claim 11, wherein said cutting means is mounted to a support assembly above said table by a four-bar linkage.

15. A system as claimed in claim 14, further including a hydraulic cylinder connected to said linkage to move said linkage and adjust the height of said cutting means, a sensor device to detect the height of the bales, and control circuitry to control said hydraulic cylinder in response to an output of said sensor device.

16. A system as claimed in claim 11, wherein said cutting means a rotatable toothed blade.

* * * * *

UNITED STATES PATENT AND TRADEMARK OFFICE

CERTIFICATE OF CORRECTION

PATENT NO. : 5,375,316
DATED : December 27, 1994
INVENTOR(S) : Wayne Carlson, Carl N. Winans, Frank Maniatis and Thomas Johnstone It is certified that error appears in the above-indêntified patent and that said Letters Patent is hereby corrected as shown below:

Col. 8, line 54, after "means", insert --is--.

Signed and Sealed this

Fifth Day of September, 1995

Bruce Lehman

*Attest:*

BRUCE LEHMAN

*Attesting Officer*

*Commissioner of Patents and Trademarks*